US010527062B2

(12) United States Patent
Yanagisawa et al.

(10) Patent No.: US 10,527,062 B2
(45) Date of Patent: Jan. 7, 2020

(54) CENTRIFUGAL COMPRESSOR

(71) Applicant: MITSUBISHI HEAVY INDUSTRIES COMPRESSOR CORPORATION, Tokyo (JP)

(72) Inventors: Eiichi Yanagisawa, Tokyo (JP); Kazutoshi Yokoo, Tokyo (JP); Noriyuki Okada, Tokyo (JP); Yuji Masuda, Hiroshima (JP); Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 37 days.

(21) Appl. No.: 15/761,678

(22) PCT Filed: Nov. 13, 2015

(86) PCT No.: PCT/JP2015/081965
§ 371 (c)(1),
(2) Date: Mar. 20, 2018

(87) PCT Pub. No.: WO2017/081810
PCT Pub. Date: May 18, 2017

(65) Prior Publication Data

US 2018/0347589 A1 Dec. 6, 2018

(51) Int. Cl.
*F04D 29/58* (2006.01)
*F04D 29/42* (2006.01)
(Continued)

(52) U.S. Cl.
CPC ..... *F04D 29/5853* (2013.01); *F04D 17/122* (2013.01); *F04D 29/2294* (2013.01); *F04D 29/4213* (2013.01); *F04D 29/5833* (2013.01)

(58) Field of Classification Search
CPC ..... F04D 29/5853; F04D 17/122; F04D 29/5833; F04D 29/2294; F04D 29/4213; F04D 29/102; F04D 17/125
See application file for complete search history.

(56) References Cited

U.S. PATENT DOCUMENTS 3,758,226 A * 9/1973 Gyurech ..... F04D 29/063 415/104
3,976,165 A * 8/1976 Pilarczyk ..... F01D 25/186 184/6.16
(Continued)

FOREIGN PATENT DOCUMENTS

DE 102012203144 A1 8/2013
JP S54-55505 U 4/1979
(Continued)

OTHER PUBLICATIONS

International Search Report for corresponding International Application No. PCT/JP2015/081965, dated Feb. 16, 2016 (4 pages).
(Continued)

*Primary Examiner* — Eldon T Brockman
(74) *Attorney, Agent, or Firm* — Osha Liang LLP

(57) ABSTRACT

A centrifugal compressor includes a rotor including: a shaft that extends along an axis and an impeller that is fixed to an outer surface of the shaft and feeds a fluid that flows into a first side in an axial direction to an outer side in a radial direction of the axis under pressure; a diaphragm that surrounds the impeller from an outer circumference side; a first casing head disposed at a second side of the diaphragm in the axial direction at an interval; a seal device disposed between the first casing head and the shaft; and a bearing device disposed at the second side in the axial direction with respect to the seal device and disposed between the first casing head and the shaft.

6 Claims, 5 Drawing Sheets

(51) Int. Cl.
*F04D 17/12* (2006.01)
*F04D 29/22* (2006.01)

(56) References Cited

U.S. PATENT DOCUMENTS

| | | | | |
|---|---|---|---|---|
| 9,631,637 | B2 * | 4/2017 | Sassanelli | F04D 29/124 |
| 2013/0058769 | A1 * | 3/2013 | Sassanelli | F04D 29/124 415/180 |
| 2013/0259665 | A1 * | 10/2013 | Ota | F04D 17/125 415/182.1 |
| 2015/0330407 | A1 * | 11/2015 | Klett | F04D 17/122 415/48 |

FOREIGN PATENT DOCUMENTS

| | | | |
|---|---|---|---|
| JP | S54-132809 | U | 9/1979 |
| JP | S64-021298 | U | 2/1989 |
| JP | 2008-138577 | A | 6/2008 |
| JP | 2008-309123 | A | 12/2008 |
| JP | 4980699 | B2 | 7/2012 |
| JP | 2012-177339 | A | 9/2012 |
| JP | 2013-513064 | A | 4/2013 |
| WO | 2014/187786 | A2 | 11/2014 |

OTHER PUBLICATIONS

Written Opinion for corresponding International Application No. PCT/JP2015/081965, dated Feb. 16, 2016 (11 pages).

* cited by examiner

CENTRIFUGAL COMPRESSOR

TECHNICAL FIELD

The present invention relates to a centrifugal compressor that compresses a fluid using an impeller.

BACKGROUND ART

As is well known, centrifugal compressors pass a fluid such as air or gas in a radial direction of a rotating impeller, and compress the fluid using a centrifugal force generated at that time. Among these centrifugal compressors, a multi-stage centrifugal compressor that includes impellers in multiple stages in a direction of an axis and gradually compresses a fluid is known.

To be specific, the centrifugal compressor includes a casing, and a rotor housed in the casing. The rotor has a shaft and an impeller fixed to an outer surface of the shaft. A fluid suctioned from a suction port of the casing is given a centrifugal force by the impeller, and kinetic energy thereof is converted into pressure energy by a diffuser and a scroll part. The fluid is sent out of a discharge port of the casing.

According to the requirements of various plants, various centrifugal compressors are produced. In recent years, a centrifugal compressor for compressing a fluid of ultralow temperature (e.g., −160° C.) has been developed, for example, as a compressor for an LNG boil off gas (e.g., see Patent Document 1).

CITATION LIST

Patent Literature

[Patent Document 1]

Japanese Patent No. 4980699

Meanwhile, for example, in the centrifugal compressor for compressing the cryogenic fluid, when the fluid was suctioned, a casing head adjacent to a suction port was sometimes deformed due to an excessive change in temperature. As the casing head was deformed, a function of a seal device for sealing a space between the casing head and a rotor was not sufficiently fulfilled. Due to the deformation of the casing head, there was a possibility of failure of a bearing that was installed on the casing head and rotatably supported the rotor.

SUMMARY OF INVENTION

One or more embodiments of the present invention provide a centrifugal compressor capable of inhibiting failure from occurring at a seal device and a bearing device.

According to a first aspect of the present invention, a centrifugal compressor includes: a rotor having a shaft that extends along an axis and an impeller that is fixed to an outer surface of the shaft and feeds a fluid, which flows into a first side in an axial direction, to an outer side in a radial direction of the axis under pressure; a diaphragm configured to surround the impeller from an outer circumference side; a first casing head disposed at a second side of the diaphragm in the axial direction at an interval; a seal device disposed between the first casing head and the shaft; a bearing device disposed at the second side in the axial direction with respect to the seal device and disposed between the first casing head and the shaft; and a shield part fixed to a first side of the first casing head in the axial direction, and configured to define a suction flow passage for introducing fluid into the impeller along with the diaphragm and to define an insulating space between the shield part and the first casing head.

According to one or more embodiments of this constitution, heat of the fluid flowing along the suction flow passage is hardly transferred to the first casing head by the insulating space, and the first casing head can be inhibited from being deformed by heat. Thereby, failure can be inhibited from occurring at the seal device and the bearing device.

In the centrifugal compressor according to one or more embodiments, the shield part may be fixed to only an end of the first casing head at the outer side in the radial direction, and be formed such that a clearance is provided between an end of the shield part at an inner side in the radial direction and an outer circumferential surface of the shaft.

According to one or more embodiments of this constitution, even when the shield part is deformed by the heat of the fluid flowing along the suction flow passage, stress occurring at the shield part can be relieved, compared to a case in which an inner side of the shield part in the radial direction is fixed.

The centrifugal compressor according to one or more embodiments may further include a temperature regulator having: a pipe line formed inside the first casing head; a temperature regulator main body connected to the pipe line; and a heat medium introduced into the temperature regulator main body via the pipe line.

According to one or more embodiments of this constitution, the first casing head can be heated or cooled according to a temperature of the fluid flowing to the suction flow passage. Thereby, even which the heat of the fluid flowing along the suction flow passage is transferred to the first casing head, thermal deformation of the first casing head can be limited.

The centrifugal compressor according to one or more embodiments may further include: a second casing head disposed at a first side of the diaphragm in the axial direction at an interval; a discharge side bearing device disposed between the second casing head and the shaft; and a second shield part fixed to a second side of the second casing head in the axial direction and configured to define a discharge flow passage discharging the fluid from the impeller along with the diaphragm and to define a discharge side insulating space between the second shield part and the second casing head.

According to one or more embodiments of this constitution, the heat of the fluid flowing to the discharge flow passage is not easily transferred to the second casing head, and the second casing head can be inhibited from being deformed by heat. Thereby, failure can be inhibited from occurring at the discharge side bearing device.

The centrifugal compressor according to one or more embodiments may further include an insulator filled in at least one of a first insulating space and a second insulating space.

According to one or more embodiments of this constitution, the heat of the fluid flowing to the suction flow passage and the discharge flow passage cannot be easily transferred to the first casing head.

In the centrifugal compressor according to one or more embodiments, the shield part may have a shield member in which an end thereof at an outer side in the radial direction and an end thereof at an inner side in the radial direction are fixed to a first side of the first casing head in the axial direction, and the insulating space may be sealed by the shield member.

According to one or more embodiments of this constitution, the insulating space and the suction flow passage can be completely interrupted. In addition, rigidity of the shield part can be further enhanced.

The centrifugal compressor according to one or more embodiments may further include a seal device provided for at least one of a plurality of fixing parts of the shield member and the first casing head.

According to one or more embodiments of this constitution, a sealing degree of the insulating space can be improved.

According to one or more embodiments of this constitution, due to an insulating space, heat of a fluid flowing to a suction flow passage is not easily transferred to a first casing head, and the first casing head can be inhibited from being deformed by the heat. Thereby, failure can be inhibited from occurring at a seal device and a bearing device.

DESCRIPTION OF EMBODIMENTS

Embodiments of the present invention will be described in detail with reference to the drawings. In the present embodiments, a multistage centrifugal compressor having a plurality of impellers will be described as an example of a centrifugal compressor.

Figure 1:
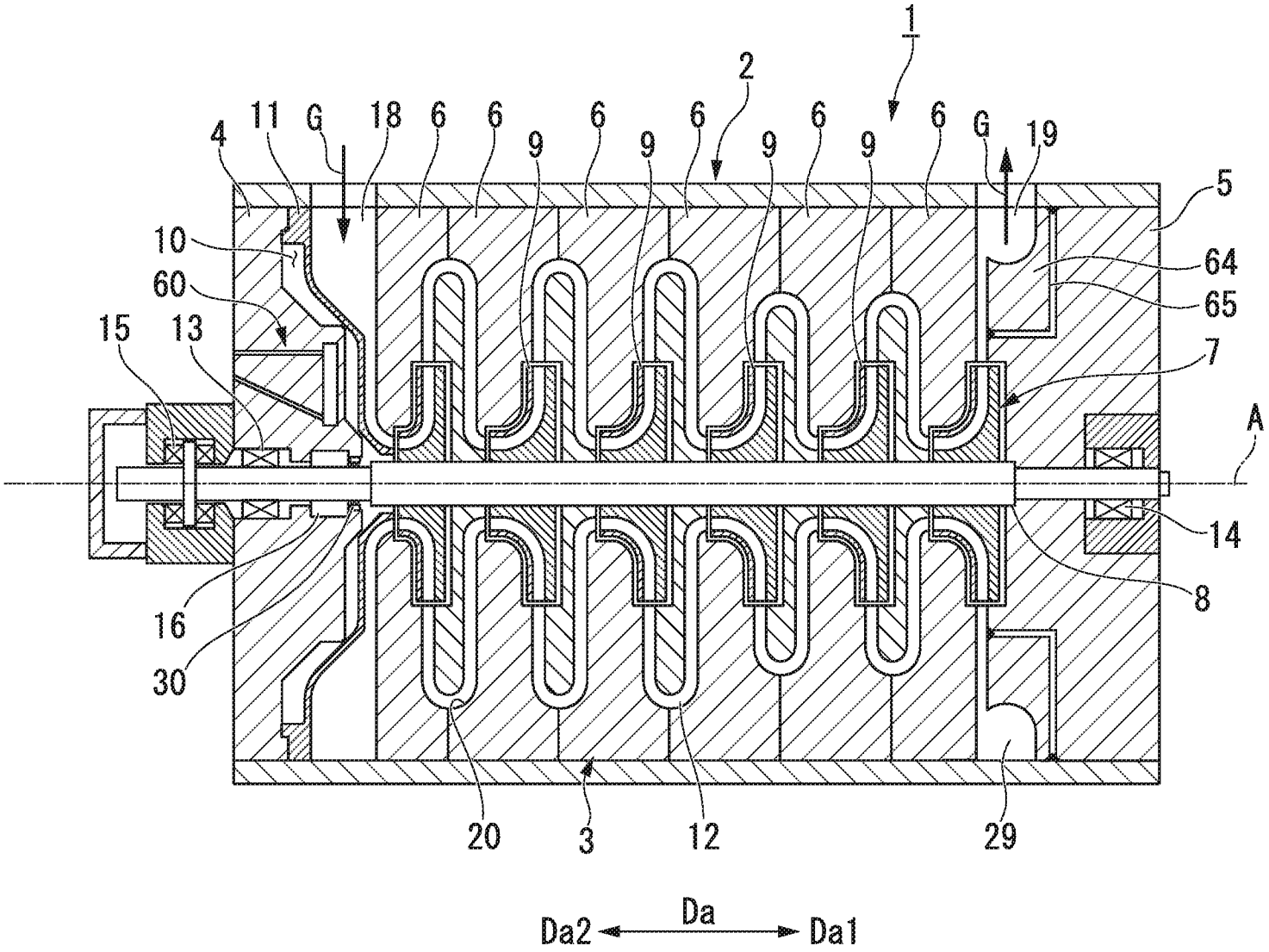
FIG. 1 is a sectional view showing a constitution of a centrifugal compressor of a first embodiment of the present invention.

As shown in FIG. 1, a centrifugal compressor 1 of the present embodiment includes a casing 2, and a rotor 7 that is rotatably supported in the casing 2. The rotor 7 has a shaft 8 that extends along an axis A, and a plurality of impellers 9 that are fixed to an outer surface of the shaft 8.

In the following description, a direction in which the axis A of the rotor 7 extends is defined as an axial direction Da. A direction orthogonal to the axis A is defined as a radial direction. A side away from the axis A in the radial direction is referred to as an outer side in the radial direction, and a side close to the axis A in the radial direction is referred to as an inner side in the radial direction. The right side of FIG. 1 in the axial direction Da is referred to as a first side Da1 in the axial direction, and the left side of FIG. 1 is referred to as a second side Da2 in the axial direction.

The casing 2 has a diaphragm 3 that surrounds the impellers 9 from outer circumferential sides thereof, a first casing head 4 that is disposed at the second side Da2 in the axial direction of the diaphragm 3 at an interval, a second casing head 5 that is disposed at the first side Da1 in the axial direction of the diaphragm 3 at an interval, and a shield plate (a shield part) 11 that is fixed to the first casing head 4.

The diaphragm 3 has a structure in which a plurality of diaphragm segments 6 are arranged in the axial direction Da.

The impellers 9 are mounted on an outer surface of the shaft 8, and feed a fluid G such as air, which flows from the second side Da2 in the axial direction to the first side Da1 in the axial direction, toward the outer side in the radial direction under pressure using a centrifugal force.

The casing 2 rotatably supports the rotor 7. The casing 2 is formed with a flow passage 12 that causes the fluid G to flow from an upstream side (the second side Da2 in the axial direction) to a downstream side (the first side Da1 in the axial direction).

The casing 2 is formed to have an approximately columnar contour, and the rotor 7 is disposed to pass through the center of the casing 2. The first casing head 4 is provided with a first journal bearing 13 that is a bearing device for rotatably supporting an end of the rotor 7 at the second side Da2 in the axial direction. The first journal bearing 13 is fixed to the first casing head 4. A thrust bearing 15 is provided at the second side Da2 in the axial direction of the first journal bearing 13.

A dry gas seal 16 is provided at the inner side in the radial direction of the first casing head 4. The dry gas seal 16 is provided at the first side Da1 in the axial direction of the first journal bearing 13. The dry gas seal 16 is a seal device that performs sealing by ejecting a gas such as dry gas. The seal device is not limited to the dry gas seal 16, and anything that can seal a clearance between the first casing head 4 and the shaft 8 may be properly adopted. For example, as the seal device, a labyrinth seal may be installed between the first casing head 4 and the shaft 8.

A seal fin 30 having a plurality of fins is provided at the first side Da1 in the axial direction of the dry gas seal 16.

A second journal bearing (a discharge side bearing device) 14 for rotatably supporting an end of the rotor 7 at the first side Da1 in the axial direction is provided at the inner side in the radial direction of the second casing head 5. The second journal bearing 14 is fixed to the second casing head 5.

A suction port (a suction flow passage) 18 for introducing the fluid G from the outside is provided at an end of the casing 2 at the second side Da2 in the axial direction. The suction port 18 is defined by the shield plate 11 and the diaphragm 3.

A discharge port (a discharge flow passage) 19 through which the fluid G is discharged to the outside is provided at an end of the casing 2 at the first side in the axial direction. The discharge port 19 is defined by a discharge side shield member 64 and the diaphragm 3.

An internal space 20 which communicates the suction port 18 and the discharge port 19 and in which decrease and increase in diameter is repeated is provided in the casing 2. The internal space 20 functions as a space for housing the impellers 9, and also functions as the flow passage 12 described above. That is, the suction port 18 and the discharge port 19 communicate via the impellers 9 and the flow passage 12.

Figure 2:
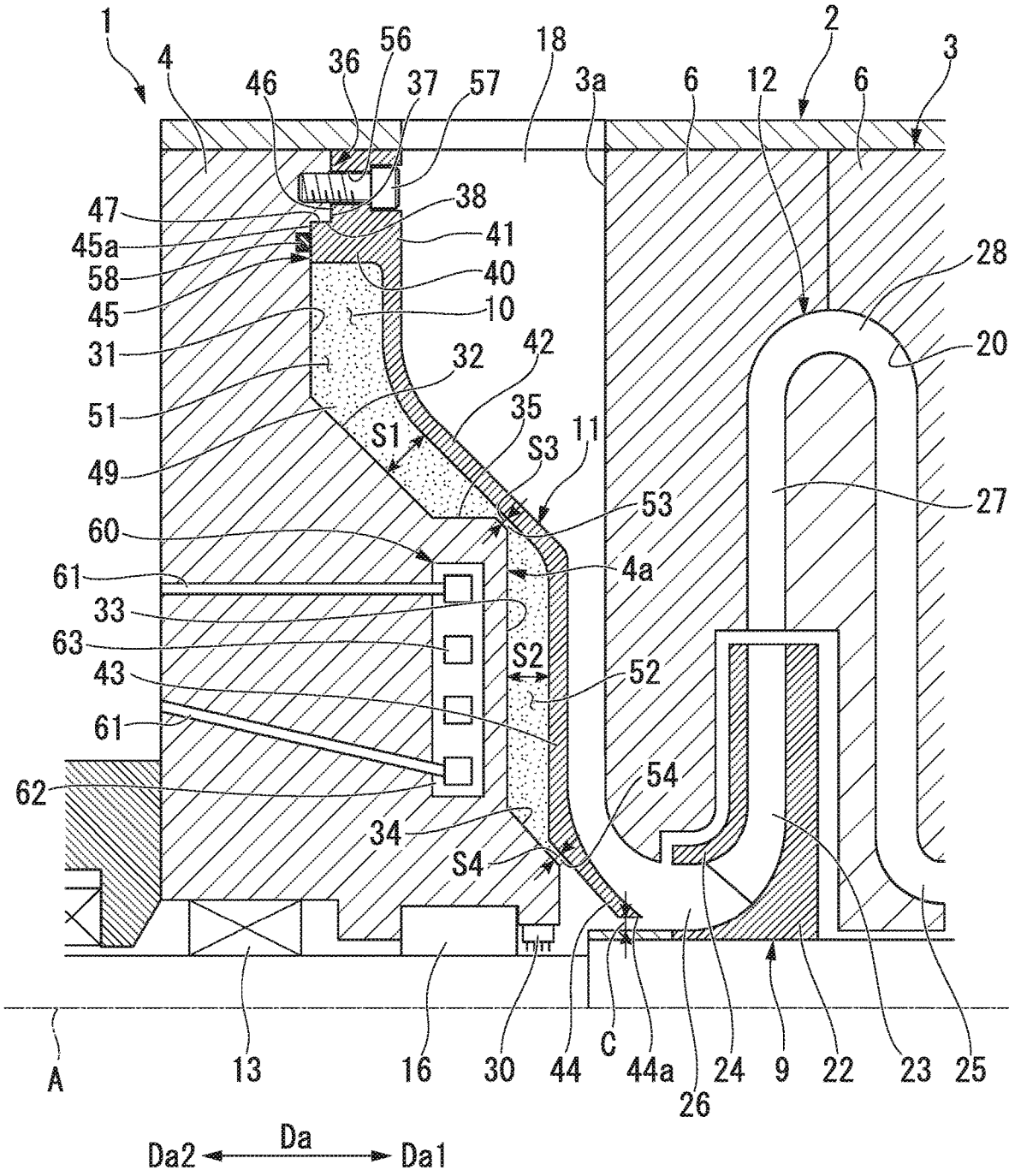
FIG. 2 is a sectional view around a suction port of the centrifugal compressor of the first embodiment of the present invention.

The plurality of impellers 9 are arranged at intervals in the axial direction Da. The number of provided impellers 9 is six in the shown example, but it may be at least one. As shown in FIG. 2, each of the impellers 9 is made up of an approximately discoid hub 22 whose diameter is gradually increased toward the first side Da1 in the axial direction, a plurality of blades 23 that are radially mounted on the hub 22 and are arranged in a circumferential direction, and a shroud 24 that is mounted to cover tip sides of the plurality of blades 23 in the circumferential direction.

The flow passage 12 is formed to connect the impellers 9 by running in the axial direction Da while meandering in the radial direction such that the fluid G is compressed step by step by the plurality of impellers 9. The flow passage 12 is mainly made up of a suction passage 25, a compression passage 26, a diffuser passage 27, and a return passage 28.

A discharge scroll 29 (see FIG. 1) for discharging the fluid G from a discharge port is provided in the casing 2.

An oil heater 60 that is a temperature regulator for heating the first casing head 4 is provided for the first casing head 4. The oil heater 60 has a pipe line 61 that is formed inside the first casing head 4, an oil heater main body (a temperature regulator main body) 62 that is connected to the pipe line 61, and a heat medium that is introduced into the oil heater main body 62 via the pipe line 61.

The pipe line 61 is connected to a heat medium supply source (not shown). The oil heater main body 62 has an annular shape, and is formed to surround the rotor 7. A heat medium flow passage 63 through which the heat medium supplied via the pipe line 61 circulates is formed in the oil heater main body 62. For example, a lubricant supplied to the journal bearings 13 and 14 as the heat medium can be supplied to the oil heater 60. The first casing head 4 can be heated or cooled by changing the temperature of the heat medium.

Next, a detailed structure of the suction port 18 of the centrifugal compressor 1 of the present embodiment will be described.

As shown in FIG. 2, the second side Da2 in the axial direction of the suction port 18 is formed by the shield plate 11 fixed to the first casing head 4, and the first side Da1 in the axial direction of the suction port 18 is formed by an end face 3*a* of the diaphragm 3. An insulating space 10 is formed between the shield plate 11 and the first casing head 4.

An end face (a head end face 4*a*) of the first casing head 4 which faces the first side Da1 in the axial direction is an annular face that extends in a circumferential direction. The head end face 4*a* has a first planar part 31 that is located at the outer side in the radial direction and is a face perpendicular to the axis A, a conical first incline part 32 which is located at the inner side in the radial direction of the first planar part 31 and whose diameter is reduced toward the first side Da1 in the axial direction, a second planar part 33 that is located at the inner side in the radial direction of the first incline part 32 and is a face perpendicular to the axis A, and a conical second incline part 34 which is located at the inner side in the radial direction of the second planar part 33 and whose diameter is reduced toward the first side Da1 in the axial direction.

The first incline part 32 and the second planar part 33 are connected by a cylindrical part 35 having a cylindrical shape that is coaxial with the axis A.

An outer edge protrusion 36 is formed at an end of the first planar part 31 at the outer side in the radial direction. The outer edge protrusion 36 is an annular protrusion that protrudes from the end of the first planar part 31 at the outer side in the radial direction to the first side Da1 in the axial direction. The outer edge protrusion 36 has a protrusion principal surface 37 that is a surface parallel to a principal surface of the first planar part 31 and is offset to the first side Da1 in the axial direction with respect to the principal surface of the first planar part 31.

The shield plate 11 is an annular plate-like member that extends in a circumferential direction. The shield plate 11 has a fixing part 40 that is located at the outer side in the radial direction, a first disk part 41 that is formed at the first side Da1 in the axial direction of the fixing part 40, a first conical part 42 that is connected to the inner side in the radial direction of the first disk part 41, a second disk part 43 that is connected to the inner side in the radial direction of the first conical part 42, and a second conical part 44 that is connected to the inner side in the radial direction of the second disk part 43.

The shield plate 11 is fixed to the first planar part 31 of a head incline via the fixing part 40. The shield plate 11 has a cantilever structure that is fixed to the first planar part 31 by only the fixing part 40. The inner side in the radial direction of the shield plate 11 is a free end, and is not fixed. A clearance C is provided between an end of the shield plate 11 at the inner side in the radial direction and an outer circumferential surface of the shaft 8.

A principal surface of the first disk part 41 is perpendicular to the axis A. The first conical part 42 has a conical shape whose diameter is reduced toward the first side Da1 in the axial direction. A principal surface of the second disk part 43 is perpendicular to the axis A. The second conical part 44 has a conical shape whose diameter is reduced toward the first side Da1 in the axial direction.

The fixing part 40 is an annular part that extends in a circumferential direction and has a rectangular cross section. A plurality of through-holes 56 penetrating in the axial direction Da are formed in the fixing part 40 (only one through-hole 56 is shown in FIG. 2). The plurality of through-holes 56 are formed at regular intervals in the circumferential direction. The shield plate 11 is fixed to the first planar part 31 by fastening bolts 57 inserted into the through-holes 56 in female threaded holes formed in the first planar part 31.

An annular convex part 45 is formed on a fixing part principal surface 46 that is a surface of the fixing part 40 which faces the second side Da2 in the axial direction. The annular convex part 45 is an annular protrusion that protrudes from the fixing part principal surface 46 to the second side Da2 in the axial direction. The annular convex part 45 has an annular convex part principal surface 45*a* that is a surface parallel to the fixing part principal surface 46 and is offset to the second side Da2 in the axial direction with respect to the fixing part principal surface 46.

The fixing part 40 of the shield plate 11 and the first planar part 31 of the first casing head 4 are connected in a so-called pillbox structure. In detail, the annular convex part 45 having a smaller outer diameter than the first casing head 4 is formed at the fixing part 40 of the shield plate 11. The outer edge protrusion 36 that is an annular protrusion is formed at the first planar part 31 of the head end face 4*a*.

An outer circumferential surface 47 of the annular convex part 45 and an inner circumferential surface 38 of the outer edge protrusion 36 are in surface contact with each other. That is, the annular convex part 45 is fitted to the inner side in the radial direction of the outer edge protrusion 36, and thereby the shield plate 11 is positioned. The amount of protrusion of the annular convex part 45 from the fixing part principal surface 46 is equal to an amount of protrusion of the outer edge protrusion 36 from the first planar part 31. Thereby, the fixing part principal surface 46 of the fixing part 40 and the protrusion principal surface 37 of the first planar part 31 are in surface contact with each other, and the annular convex part principal surface 45*a* of the fixing part 40 and the first planar part 31 are in surface contact with each other.

A seal ring 58 is provided for the first planar part 31 facing the annular convex part principal surface 45*a* of the annular convex part 45. That is, the seal ring 58 fitted into an annular groove formed in the first planar part 31 is in close contact with the annular convex part principal surface 45*a*.

An annular space is formed between the head end face 4*a* of the first casing head 4 and the shield plate 11. Hereinafter, this annular space is referred to as the insulating space 10.

An insulator 49 that reduces transfer of heat of the shield plate 11 to the first casing head 4 is filled in the insulating space 10 without a clearance. The insulator 49 does not essentially need to be filled.

The first incline part 32 of the head end face 4*a* and the first conical part 42 of the shield plate 11 are disposed in parallel at a predetermined interval in the axial direction Da. The space between the first incline part 32 and the first conical part 42 is referred to as a first insulating space 51. The interval between the first incline part 32 and the first conical part 42 is referred to as a first interval S1.

Likewise, a space between the second planar part 33 and the second disk part 43 is referred to as a second insulating space 52. The interval between the second planar part 33 and the second disk part 43 is referred to as a second interval S2.

A first narrow part 53 at which an interval between the shield plate 11 and the head end face 4*a* is formed to be narrower than the first interval S1 and the second interval S2 is provided between the first insulating space 51 and the second insulating space 52.

A second narrow part 54 at which the interval between the shield plate 11 and the head end face 4*a* is formed to be narrower than the first interval S1 and the second interval S2 is provided between the second insulating space 52 and the clearance C.

The interval between the shield plate 11 and the head end face 4*a* at the first narrow part 53 is referred to as a third interval S3.

The interval between the shield plate 11 and the head end face 4*a* at the second narrow part 54 is referred to as a fourth interval S4.

The dimensions of the third interval S3, the fourth interval S4, and the clearance C are approximately the same. That is, the dimensions of the third interval S3, the fourth interval S4, and the clearance C are sufficiently smaller than the first interval S1 and the second interval S2.

Next, the detailed structure of the discharge port 19 of the centrifugal compressor 1 of the present embodiment will be described.

Figure 3:
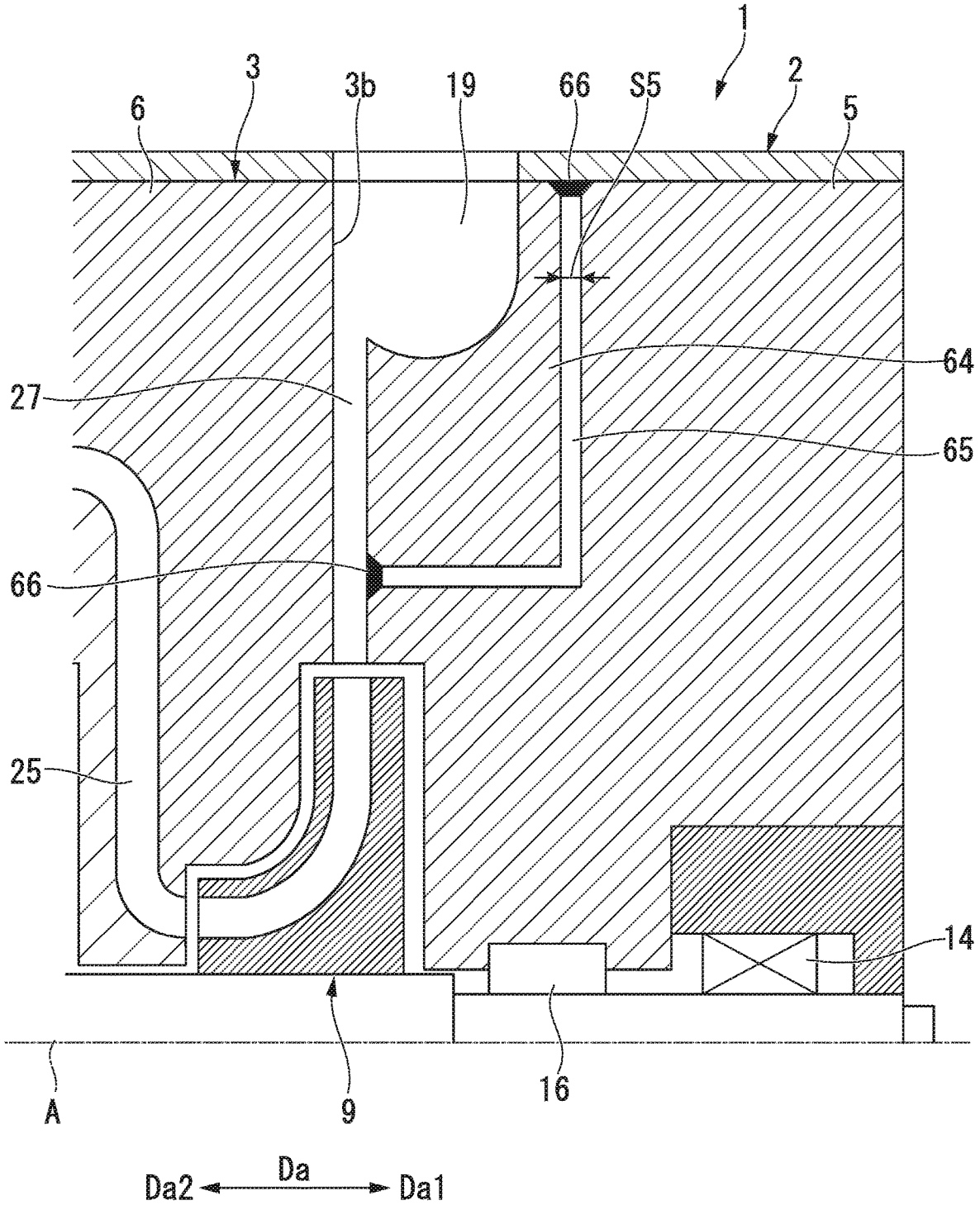
FIG. 3 is a sectional view around a discharge port of the centrifugal compressor of the first embodiment of the present invention.

As shown in FIG. 3, the first side Da1 in the axial direction of the discharge port 19 is defined by the discharge side shield member 64 fixed to the second casing head 5, and the first side Da1 in the axial direction of the discharge port 19 is defined by the end face 3*b* of the diaphragm 3. A discharge side insulating space 65 is formed between the discharge side shield member 64 and the first casing head 4.

The discharge side shield member 64 is fixed to the second casing head 5 by welding. The discharge side insulating space 65 is sealed by a weld zone 66.

The discharge side shield member 64 is a block-like member formed in an annular shape. An interval (a fifth interval S5) between the discharge side shield member 64 and the second casing head 5 is uniformly formed. The dimension of the fifth interval S5 may be set to be equal to, for instance, the third interval S3 or the fourth interval S4 (see FIG. 2).

The dimension of the fifth interval S5 is not limited thereto, and may be set to be equal to the first interval S1, and the insulator 49 may be filled in the discharge side insulating space 65.

According to the above embodiment, heat of the fluid G flowing along the suction port 18 is hardly transferred to the first casing head 4 by the insulating space 10, and the first casing head 4 can be inhibited from being deformed by heat.

Thereby, failure can be inhibited from occurring at the dry gas seal 16 and the first journal bearing 13. That is, the first casing head 4 is deformed, and an influence of the deformation can be prevented from being exerted on the dry gas seal 16 installed at the inner side in the radial direction of the first casing head 4. In addition, the first casing head 4 is deformed, and a clearance of the first journal bearing 13 installed at the inner side in the radial direction of the first casing head 4 can be inhibited from being changed.

The narrow parts 53 and 54 are provided, and thereby work of filling the insulator 49 in the insulating space 10 can be facilitated. That is, the narrow parts 53 and 54 are provided, and thereby the insulator 49 can be reliably held.

The shield plate 11 is formed in the cantilever structure, and the clearance C is provided between the shield plate 11 and the shaft 8. Thereby, in comparison with the case in which the inner side in the radial direction of the shield plate 11 is fixed, even when the shield plate 11 is deformed by the heat of the fluid G flowing along the suction port 18, stress occurring at the shield plate 11 can be relieved. That is, when the end of the shield plate 11 at the outer side in the radial direction and the end of the shield plate 11 at the inner side in the radial direction are fixed, stress occurs inside the shield plate 11 along with thermal deformation of the shield plate 11. However, the shield plate 11 is formed in the cantilever structure, and thereby occurrences of the stress can be limited.

The shield plate 11 is fixed using the pillbox structure, and thereby centering of the shield plate 11 during mounting can be facilitated. That is, the clearance C between the shield plate 11 and the shaft 8 can be made constant.

The oil heater 60 is provided for the first casing head 4, and thereby the first casing head 4 can be heated. Thereby, the thermal deformation of the first casing head 4 can be limited.

A refrigerant flows along the heat medium flow passage 63 of the oil heater 60, and thereby the first casing head 4 can be cooled. That is, the first casing head 4 can be heated or cooled according to the temperature of the fluid G flowing to the suction port 18.

The heat of the fluid G flowing to the discharge port 19 is not easily transferred to the second casing head 5 by the discharge side insulating space 65, and the second casing head 5 can be inhibited from being deformed by heat.

The above embodiment is configured to include the two narrow parts 53 and 54, but it is not limited thereto. For example, only the second narrow part 54 may be provided to set the insulating space 10 as one space.

Second Embodiment

Hereinafter, a centrifugal compressor 1B of a second embodiment of the present invention will be described on the basis of the drawings. In the present embodiment, a difference from the aforementioned first embodiment will be mainly described, and a description of the same portions will be omitted.

A fixing part 40 of a shield plate 11B and a first planar part 31 of a first casing head 4 in the present embodiment are the same as in the first embodiment, and are connected by a pillbox structure. In the centrifugal compressor 1 of the first embodiment, the part fitted inside is formed at the shield plate 11 side. In contrast, the pillbox structure of the present embodiment is different in that the part fitted inside is formed at the first casing head 4 side.

Figure 4:
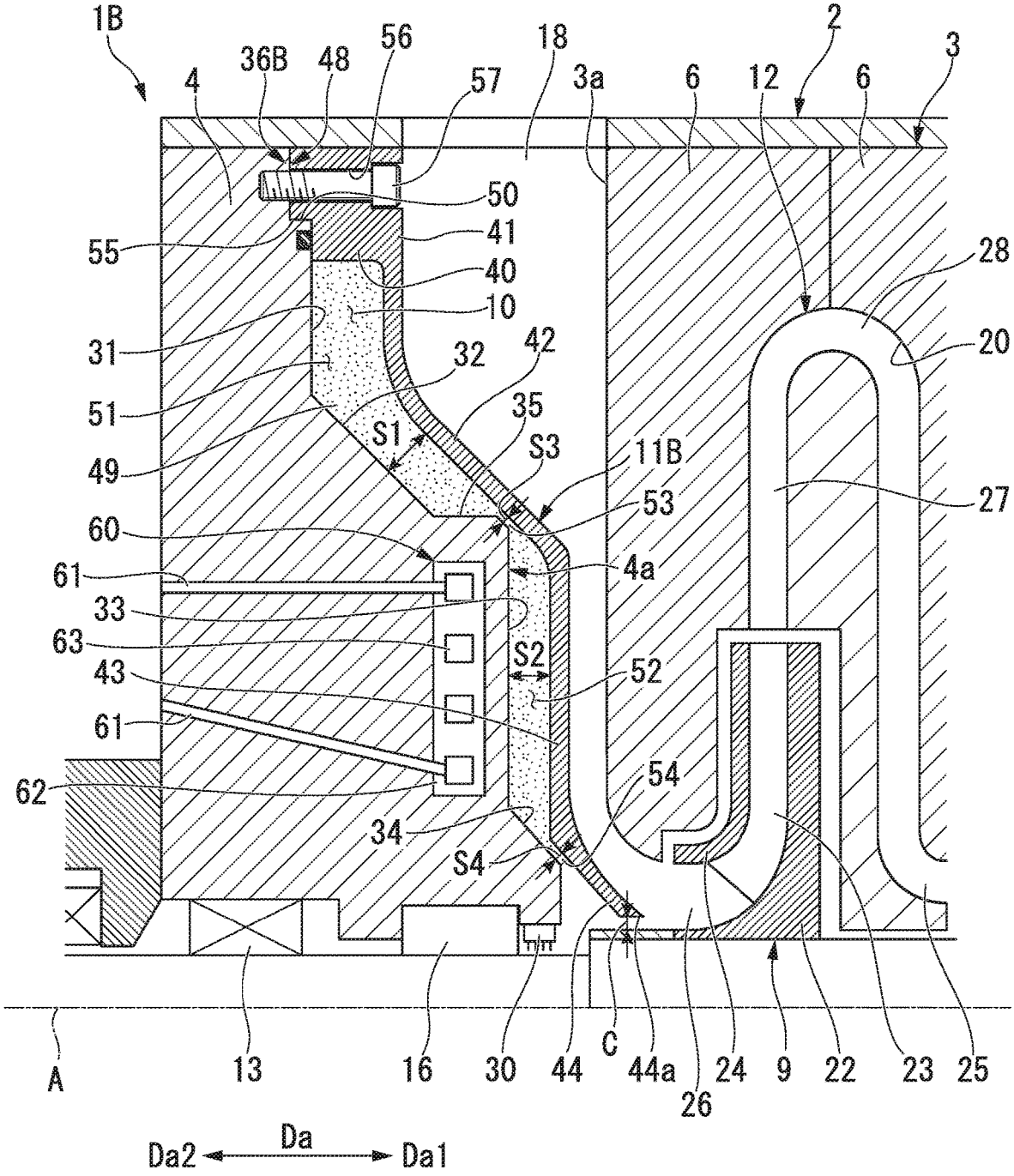
FIG. 4 is a sectional view around a suction port of a centrifugal compressor of a second embodiment of the present invention.

As shown in FIG. 4, a second outer edge protrusion 36B equivalent to the outer edge protrusion 36 of the first embodiment (see FIG. 2) is formed at the fixing part 40 of the present embodiment. An annular concave part 48 corresponding to the second outer edge protrusion 36B is formed in an end of the first planar part 31 of the present embodiment at an outer side in a radial direction. A circumferential surface of the annular concave part 48 at the first planar part 31 is in surface contact with an inner circumferential surface 55 of the second outer edge protrusion 36B.

According to the above embodiment, a fluid G introduced from a suction port 18 has a high temperature, and the shield plate 11B is expanded by heat. In this case, the second outer edge protrusion 36B of the fixing part 40 moves to the outer side in the radial direction. Thereby, since the entire shield plate 11B also moves to the outer side in the radial direction, an end of the shield plate 11B at an inner side in the radial direction can be prevented from coming into contact with the shaft 8.

Third Embodiment

Hereinafter, a centrifugal compressor 1C of a third embodiment of the present invention will be described on the basis of the drawings. In the present embodiment, a difference from the aforementioned first embodiment will be mainly described, and a description of the same portions will be omitted.

Figure 5:
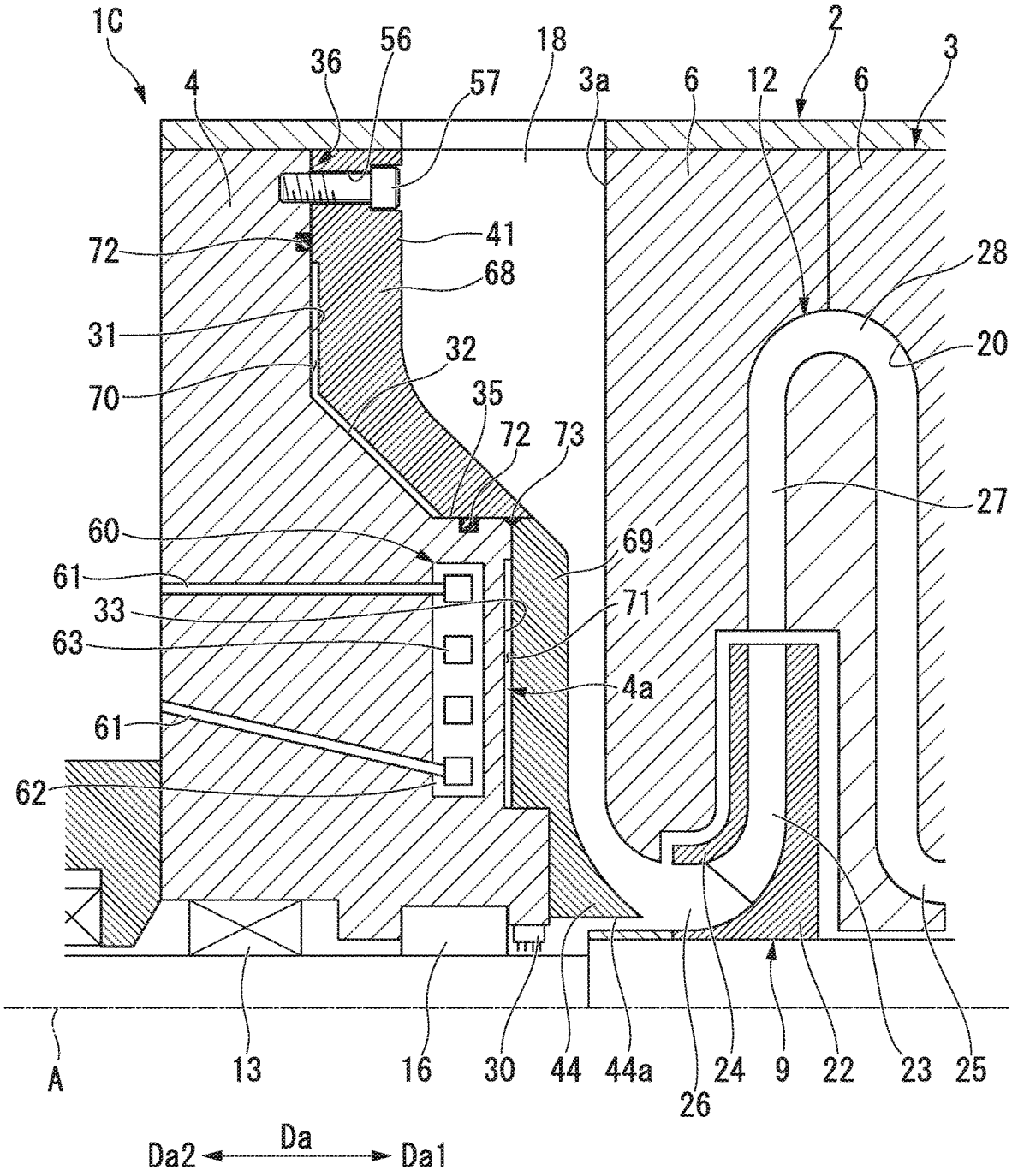
FIG. 5 is a sectional view around the suction port of the centrifugal compressor of the second embodiment of the present invention.

As shown in FIG. 5, the centrifugal compressor 1C of the present embodiment has a block-shaped first shield member 68 and a block-shaped second shield member 69, each of which is used as a shield part for interrupting heat of a fluid G. That is, the shield parts of the present embodiment have a sufficient thickness in an axial direction Da unlike the plate-like shield plate 11 of the first embodiment. The first shield member 68 is fixed at an outer side in a radial direction of a head end face 4*a* of a first casing head 4. The second shield member 69 is fixed at an inner side in the radial direction of the head end face 4*a*.

A first insulating space 51 that is a slit-like space extending in a circumferential direction is formed between the first shield member 68 and the first casing head 4. The first insulating space 51 is sealed by a seal ring 72 that is a seal device. That is, the seal ring 72 fitted into an annular groove formed in the head end face 4*a* is in close contact with a surface of the first shield member 68 which faces the second side Da2 in the axial direction. The first shield member 68 is fixed to the first casing head 4 by bolts 57.

A second insulating space 52 extending in the circumferential direction is formed between the second shield member 69 and the first casing head 4. The second shield member 69 is bonded to the first casing head 4 by welding. The outer side in the radial direction of the second insulating space 52 is sealed by a weld zone 73.

A method of fixing the first shield member 68 and the second shield member 69 is not limited to the aforementioned method. For example, the first shield member 68 may be fixed to the first casing head 4 by welding.

According to this constitution, rigidity of the shield part can be further enhanced. Since the insulating spaces 70 and 71 are sealed by the seal ring 72 or the weld zone 73, the insulating spaces 70 and 71 can be kept under vacuum or in a state close to the vacuum.

The present embodiment is configured to provide the two shield members and the two insulating spaces, but it is not limited thereto. The present embodiment may be configured to seal one insulating space using one shield member.

The embodiments of the present invention have been described in detail, but can be variously modified without departing from the technical idea of the present invention.

For example, the above embodiments are also configured to provide the insulating space at the discharge port 19 side, but they are not limited thereto. That is, the discharge side insulating space 65 does not essentially need to be provided.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1, 1B, 1C Centrifugal compressor
2 Casing
3 Diaphragm
4 First casing head
4*a* Head end face
5 Second casing head
7 Rotor
8 Shaft
9 Impeller
10 Insulating space
11, 11B Shield plate
12 Flow passage
13 First journal bearing
14 Second journal bearing
15 Thrust bearing
16 Dry gas seal (seal device)
18 Suction port (suction flow passage)
19 Discharge port (discharge flow passage)
20 Internal space
30 Seal fin
31 First planar part
32 First incline part
33 Second planar part
34 Second incline part
35 Cylindrical part
36 Outer edge protrusion
36B Second outer edge protrusion
37 Protrusion principal surface
40 Fixing part
41 First disk part
42 First conical part
43 Second disk part
44 Second conical part
45 Annular convex part
45*a* Annular convex part principal surface
46 Fixing part principal surface
48 Annular concave part
49 Insulator
51 First insulating space
52 Second insulating space
53 First narrow part
54 Second narrow part
60 Oil heater (temperature regulator)
62 Oil heater main body
64 Discharge side shield member
65 Discharge side insulating space
66 Weld zone
68 First shield member
69 Second shield member
70 First insulating space

71 Second insulating space
72 Seal ring (seal device)
73 Weld zone
A Axis
C Clearance
Da Axial direction
G Fluid
S1 First interval
S2 Second interval
S3 Third interval
S4 Fourth interval

The invention claimed is:

1. A centrifugal compressor comprising:

a rotor comprising a shaft that extends along an axis and an impeller that is fixed to an outer surface of the shaft and feeds a fluid that flows into a first side in an axial direction to an outer side in a radial direction of the axis under pressure;

a diaphragm that surrounds the impeller from an outer circumference side;

a first casing head disposed at a second side of the diaphragm in the axial direction at an interval;

a seal device disposed between the first casing head and the shaft;

a bearing device disposed at the second side in the axial direction with respect to the seal device and disposed between the first casing head and the shaft;

a shield part that is fixed to a first side of the first casing head in the axial direction, that defines a suction flow passage for introducing fluid into the impeller along with the diaphragm, and that defines an insulating space between the shield part and the first casing head; and an insulator filled in the insulating space, wherein the insulator is a solid material.

2. The centrifugal compressor according to claim 1, wherein the shield part is fixed to only an end of the first casing head at the outer side in the radial direction, and a clearance is provided between an end of the shield part at an inner side in the radial direction and an outer circumferential surface of the shaft.

3. The centrifugal compressor according to claim 1, further comprising a temperature regulator comprising:

a pipe line formed inside the first casing head;

a temperature regulator main body connected to the pipe line; and a heat medium introduced into the temperature regulator main body via the pipe line.

4. The centrifugal compressor according to claim 1, further comprising:

a second casing head disposed at a first side of the diaphragm in the axial direction at an interval;

a discharge side bearing device disposed between the second casing head and the shaft; and a second shield part that is fixed to a second side of the second casing head in the axial direction, that defines a discharge flow passage discharging the fluid from the impeller along with the diaphragm and that defines a discharge side insulating space between the second shield part and the second casing head.

5. The centrifugal compressor according to claim 1, wherein the shield part comprises a shield member in which an end thereof at an outer side in the radial direction and an end thereof at an inner side in the radial direction are fixed to a first side of the first casing head in the axial direction; and the insulating space is sealed by the shield member.

6. The centrifugal compressor according to claim 5, further comprising a seal ring provided for at least one of a plurality of fixing parts of the shield member and the first casing head.

* * * * *